United States Patent [19]

Larson et al.

[11] Patent Number: 5,017,451

[45] Date of Patent: May 21, 1991

[54] CONTINUOUS PROCESS FOR PREPARING RESIN PARTICLES IN A LIQUID

[75] Inventors: James R. Larson, West Chester; Kenneth W. Leffew, Kennett Square, both of Pa.

[73] Assignee: E. I. Du Pont de Nemours and Company, Wilmington, Del.

[21] Appl. No.: 440,155

[22] Filed: Nov. 22, 1989

[51] Int. Cl.[5] ..... G03G 9/13

[52] U.S. Cl. ..... 430/137; 430/114

[58] Field of Search ..... 430/137, 109, 119, 114

[56] References Cited

U.S. PATENT DOCUMENTS

| | | | |
|---|---|---|---|
| 4,760,009 | 7/1988 | Larson | 430/137 |
| 4,783,389 | 11/1988 | Trout et al. | 430/137 |
| 4,912,010 | 3/1990 | Mori et al. | 430/137 |

*Primary Examiner*—John Goodrow

[57] ABSTRACT

A continuous process for the preparation of a dispersion of liquid and resin or polymer particles having at least one additive dispersed in the resin comprising A. introducing an intimate blend of resin and at least one additive continuously into or blending the ingredients in an apparatus having means for melting the resin and dispersing the additive in the resin, B. melting the resin in the apparatus at an elevated temperature but below that at which the resin and/or additive decomposes, C. moving continuously the blend of melted resin and additive through at least one mixing element of the apparatus dispersing thoroughly the additive in the melted resin (molten blend), D. forming a dispersion by introducing into the molten blend while still in at least one mixing element a liquid in which the resin and additive(s) are substantially insoluble and thoroughly mixing molten blend in the in the liquid, the temperature in the at least one mixing element being maintained above the temperature at which the molten blend remains in its molten state, and E. introducing continuously the dispersion into a high shear cooling apparatus wherein the molten blend solidifies forming a stable dispersion of resin particles in the liquid. The process is useful for preparing resin particles in a liquid or electrostatic liquid developers more quickly and economically than by other processes, the resin or toner particles having controlled particle size.

55 Claims, 1 Drawing Sheet

FLOW CHART

CONTINUOUS PROCESS FOR PREPARING RESIN PARTICLES IN A LIQUID

DESCRIPTION

1. Technical Field

This invention relates to a continuous process for the preparation of toner particles. More particularly this invention relates to a continuous process for the preparation of a dispersion of resin particles in a liquid.

2. Background Art

It is known to develop a latent electrostatic image with toner particles dispersed or mixed in an insulating nonpolar liquid. Such mixed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid developers comprise a thermoplastic resin and nonpolar liquid. Generally a suitable colorant is present such as a dye or pigment. The colored toner particles are present in the nonpolar liquid which generally has a high-volume resistivity in excess of $10^9$ ohm centimeters, a low dielectric constant below 3.0 and a high vapor pressure. The toner particles are 30 μm determined by Malvern 3600E Particle Sizer described below. After the latent electrostatic image has been formed, the image is developed by the colored toner particles mixed in said nonpolar liquid and the image may subsequently be transferred to a carrier sheet.

There are many methods of making liquid developers. In one method of preparation the improved toner particles are prepared by dissolving one or more polymers in a nonpolar liquid, together with particles of a pigment, e.g., carbon black. The solution is cooled slowly, while stirring, whereby precipitation of particles occurs. Applicant has found that by repeating the above process material was observed that was greater than 1 mm in size. By increasing the ratio of solids to nonpolar liquid the toner particles can be controlled within the desired size range, but it has been found that the density of images produced may be relatively low and when a transfer is made to a carrier sheet, for example, the amount of image transferred thereto may be relatively low. The particles in this process are formed by a precipitation mechanism and not grinding in the presence of particulate media and this contributes to the formation of an inferior toner.

In another method of preparation of toner particles, the plasticizing of the thermoplastic polymer and pigment with a nonpolar liquid forms a gel or solid mass which is shredded into pieces, more nonpolar liquid is added, the pieces are wet-ground into particles, and grinding is continued which is believed to pull the particles apart to form fibers extending therefrom. While this process is useful in preparing improved toners, it requires long cycle times and excessive material handling, i.e., several pieces of equipment are used.

In yet another method of preparation of toner particles for electrostatic imaging, the steps include:

A. mixing at an elevated temperature in a vessel a thermoplastic resin, a nonpolar liquid having a Kauri-butanol value of less than 30, and, optionally a colorant, by means of moving particulate media whereby the moving particulate media creates shear and/or impact, while maintaining the temperature in the vessel at a temperature sufficient to plasticize and liquify the resin and below that at which the nonpolar liquid boils and the resin and/or colorant decomposes, B. cooling the mixture to permit precipitation of the resin out of the liquid, the particulate media being maintained in continuous movement during and subsequent to cooling whereby the average particle size of the toner particles is 30 μm or less determined by Malvern 3600E Particle Sizer described below and a plurality of fibers are formed, and C. separating the mixture of toner particles from the particulate media.

This method provides toners with the required particle size but requires extremely long grinding times to achieve this required particle size.

The processes described above have been found to be useful in preparing small quantities of liquid developer. However, a need still exists for the preparation of large quantities of high quality developer. It has been found that large quantities of liquid developer can be prepared using a continuous process for preparing a dispersion of resin particles in a liquid and an electrostatic liquid developer as described below.

SUMMARY OF THE INVENTION

In accordance with this invention there is provided a continuous process for the preparation of a dispersion of liquid and thermoplastic resin or polymer particles having at least one additive dispersed in the thermoplastic resin or polymer particles comprising A. introducing an intimate blend of resin and at least one additive continuously into an apparatus having means for melting the resin and dispersing the additive in the resin, B. melting the resin in the apparatus at an elevated temperature but below that at which the resin and/or additive decomposes, C. moving continuously the blend of melted resin and additive through at least one mixing element of the apparatus whereby the additive is thoroughly dispersed in the melted resin to form a molten blend, D. forming a dispersion by introducing into the molten blend while it is still in the at least one mixing element of the apparatus a liquid in which the resin and at least one additive are substantially insoluble and mixing the molten blend thoroughly in the liquid, the temperature in the at least one mixing element being maintained above the temperature at which the molten blend remains in its molten state, and E. introducing continuously the dispersion into a high shear cooling apparatus wherein the molten blend solidifies forming a stable dispersion of resin particles in the liquid, the resin particles having an average by area particle size of less than 30 μm.

DETAILED DESCRIPTION OF THE INVENTION

Figure 1:
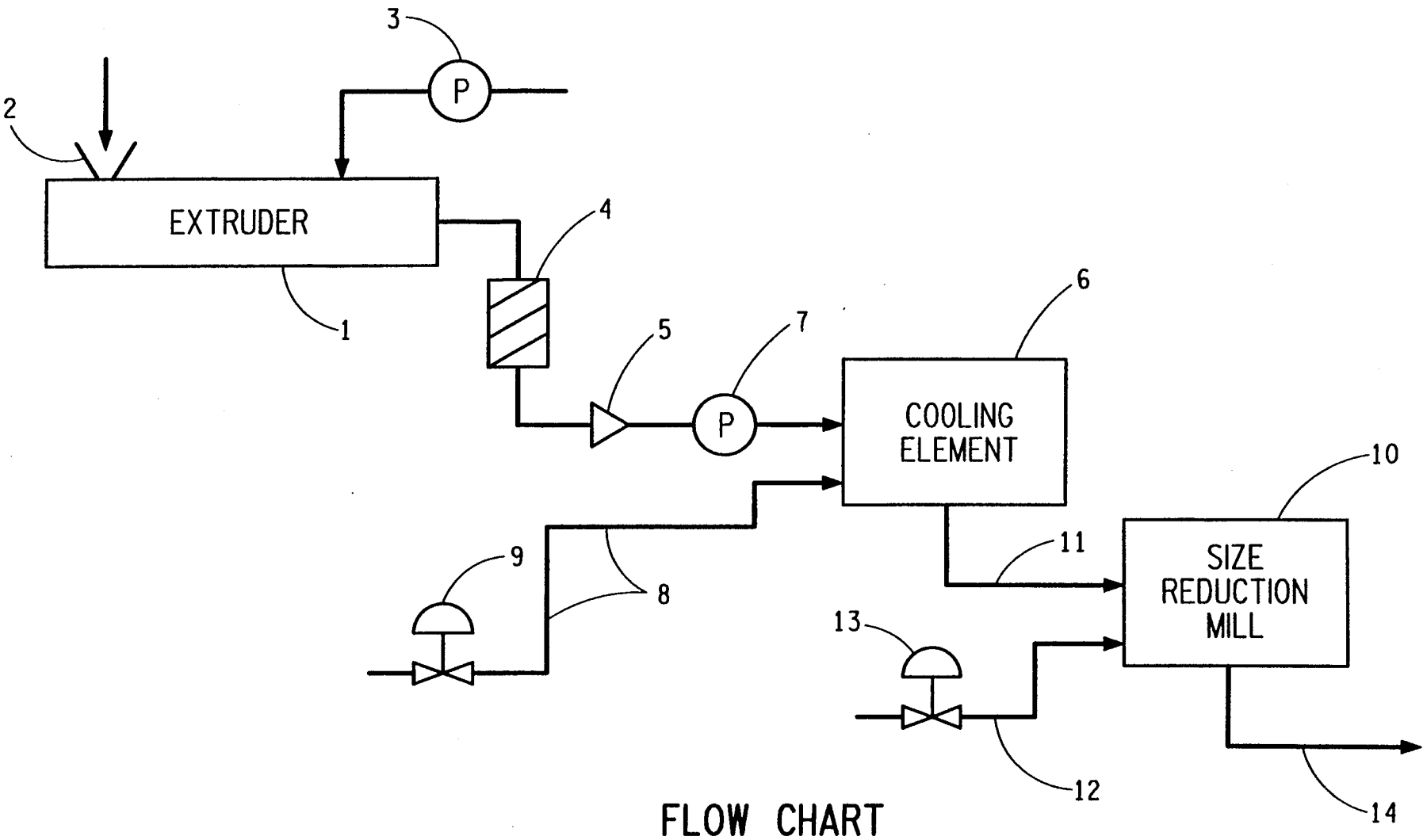
FIG. 1 is a flow chart illustrating a preferred embodiment of the invention.

The process of this invention results in the continuous preparation of a dispersion of resin particles in a liquid. As particularly described herein without limiting the invention the resin particles are preferably toner particles adapted for electrophoretic movement through a liquid.

In accordance with this invention there is provided a continuous process for the preparation of a dispersion of liquid and resin or polymer particles having at least one additive dispersed in the resin or polymer particles as described above. The process of the invention is illustrated in FIG. 1. An intimate blend of solids, i.e., resin, colorant, and optionally adjuvant, is prepared in a ribbon blender or any other similar dry blending equipment, not shown in FIG. 1, and the resultant dry blend is placed in a melt/dispersion apparatus 1, e.g., a commercial twin screw extruder, for example, a 28 mm Werner & Pfleiderer counter-rotating device, via feed hopper 2. The feed hopper 2 may be equipped with a screw auger (not shown) which is manipulated to regulate the feed rate of solid material into the feed throat of the melt/dispersion apparatus 1. Examples of solid material feeders include: all-digital loss-in-weight feeders, e.g., K-Tron's Series 7100, manufactured by K-Tron Corporation, Glassboro, N.J., etc. The temperature in the melt/dispersion apparatus 1 is sufficient to plasticize and liquefy the resin but is below that at which the resin and/or colorant or other additive decomposes. A preferred temperature range is 100° to 150° C., although other temperatures outside this range may be suitable depending on the particular ingredients used. The preferred melt/dispersion apparatus 1, e.g., twin screw extruder, has at least four zones. Zone 1 is the resin feeding zone, Zone 2 is the melting zone, Zone 3 is the kneading, blending or mixing zone, and Zone 4 is the melt pumping zone. At the end of Zone 4 there may be provided a transition zone. The screw in the twin screw extruder is designed to provide intense mixing, with from one to seven kneading block sections, preferably five kneading block sections along the length, providing a total kneading length of 30 to 350 mm, preferably 285 mm, on the 774 mm long screws. Other configurations are also possible. The screw auger may be regulated at 10 to 20 rpm providing a solid feed rate into the extruder of 5 to 10 lb./hour (0.000625–0.00125 kg/second), more preferably 15 rpm providing a solid feed rate into the extruder of about 6.8 lb/hour (0.00085 kg/second). The screws may be rotated at 150 to 350 rpm, preferably 300 rpm, to provide the required degree of dispersion of the pigment and additives into the resin. At a point from 50 to 200 mm from the feed end of the screw, in Zone 2, solid additives are introduced. At a point 600 to 700 mm, preferably 654 mm from the feed end of the screw, in Zone 3, liquid, e.g., Isopar®-L nonpolar liquid is pumped into the twin screw extruder with a positive displacement pump 3, for example, a Lapp diaphragm pump, Zenith gear pump or Pulsafeeder pump, through a liquid injector (not shown) with a 0.125 inch (~3.18 mm) orifice at its discharge. The liquid may be supplied to the positive displacement pump 3 from a tank (not shown) at atmospheric pressure and room temperature. The speed of said pump 3 may be adjusted to provide the required amount of liquid into the twin screw extruder. Since during start-up of the process, extrusion of the solid components is established before introduction of the liquid, the positive displacement pump 3 supplying the liquid must be capable of providing, and the supply system designed to sustain pressure of up to at least 800 psig, preferably 600 psig to initially establish flow into the twin screw extruder. After the flow line is fully cleared, only about 50 psig is required to maintain the required flow rate. The melt/dispersion apparatus 1 in this illustration, the extruder, may be and preferably is equipped with three heating jackets, not shown in FIG. 1, along the barrel length, each with an embedded thermocouple and valved cooling water for fine regulation of temperature. In addition, the feed throat (Zone 1) may be equipped with a cooling water jacket to ensure proper feeding of the solid material below room temperature. The first heated zone (Zone 2) is controlled to about 80° to 120° C., preferably 110° C., and the two downstream zones to 110° to 140° C., preferably 115° C. At the end of the extruder there may be and preferably is a transition zone, about 10 inches (25.4 cm) long, with two band heaters and embedded thermocouples. In the first stage of this transition zone, there may be placed a pressure transducer. The temperatures of both heaters on the transition zone are controlled to 100° to 120° C., preferably 110° C. and the pressure at the discharge of the extruder is typically less than 150 psig, preferably less than 50 psig. The transition zone is connected to a static mixer 4, e.g , Kenics Static Mixer, preferably 12 inches (30.48 cm) long. The static mixer 4 is preferably wrapped with a cord heating element (160 watts) attached to a temperature controller regulating the temperature to 150° C. The static mixer discharges into an extrusion die 5 preferably having a 1/16 inch (0.159 cm) orifice. The die is heated, e.g., with a band heater (not shown), also regulated to 140° to 180° C., preferably to 150° C. The flow rate of extrudate through the orifice of die 5 may be determined using a pressure transducer. A melt temperature of about 115° to 150° C., preferably 130° C., is maintained and this may be determined using a thermocouple. The dispersion of molten blend of additive and resin in liquid discharged from the orifice of die 5 contains about 20 to 50% solids, preferably 35% solids, and the flow is regulated to about 5 to 10 lbs/hour (0.000625 to 0.00125 kg/second, preferably 6.9 lbs/hour (0.00087 kg/sec). Any additional or waste fluid may be discharged into a storage container (not shown), where it is allowed to freeze. The dispersion from the die 5 is discharged into a funnel (not shown) which supplies feed to a high shear cooling element 6, such as a continuous ball mill, e.g., a Premier Supermill, manufactured by Premier Mill Corp., Reading, Pa. wherein a stable dispersion of resin particles in liquid is formed. A 1 inch (2.54 cm) tubing line, preferably of stainless steel, wrapped with cord heaters, connects the funnel to a positive displacement pump 7, e.g., a Moyno progressive cavity positive displacement pump, which may also be wrapped with cord heaters (not shown). The transfer line between the pump and the continuous ball mill entrance is also wrapped 1 inch (2.54 cm) tubing, for example, stainless steel. Each of these cord heaters may be manipulated to regulate the tubing temperature to 140° to 180° C., preferably 150° C., to ensure that the feed remains fluid. The continuous ball mill is filled with case-hardened steel shot, 1 mm in diameter, providing a free volume of about 665 cc. The ball mill discs are rotated at a tip speed of 1500 to 3000 ft/minute (762 to 1524 cm/second), preferably 2500 ft/minute (1270 cm/second) and the ball mill is water jacketed. The flow rate of water to the jacket is manipulated to regulate the discharge temperature of the stable dispersion to 30°–40° C. Additional liquid is added to the high shear cooling element 6 through line 8 to remove heat and dilute the stable dispersion, thus freezing the resin under the shear provided by the media. The liquid may be supplied from a nitrogen pressurized tank through an integral orifice flow meter (not shown) and a flow control valve 9. For example, if the flow of liquid is regulated at about 8.2 lb/hour (0.0010 kg/second), it results in a mean residence time in the continuous ball mill of about 246 seconds and a discharge solids loading of 16% by weight. The continuous ball mill discharge is a stable, pumpable paste or dispersion which may be stored for further processing. Alternatively, for additional particle size reduction, if required, the continuous ball mill discharge may be fed as shown in FIG. 1 into a size reduction mill 10, e.g., a continuous ball mill, through line 11. The size reduction mill 10 may be a single or multiplicity of size reduction mills in series. The stable paste or dispersion can pass through any of the size reduction mills at least one time. The stable paste or dispersion is diluted with additional liquid added through line 12 which contains a flow control valve 13, to provide a 10% by weight solids level. The diluted stable dispersion is then passed through the mill and out line 14 at a controlled flow rate. During this cold grinding stage, the temperature is always maintained below 30° C. Other suitable size reduction or grinding devices include, for example, attritor, heated vibratory mill such as a Sweco Mill manufactured by Sweco Co., Los Angeles, Calif., equipped with particulate media; Microfluidizer ® M-110 or other size, manufactured by Microfluidics, Newton, Mass. The liquid may be a polar liquid in an amount, e.g., up to 100% based on the weight of nonpolar liquid.

After reduction in size of the resin particles, the toner particles have an average particle size of less than about 30 μm, preferably less than about 15 μm, as measured using a Malvern 3600E Particle Sizer manufactured by Malvern, Southborough, Mass. which uses laser diffraction light scattering of stirred samples to determine average particle sizes. Various instruments are known to measure the particle size in addition to the Malvern instrument. One such instrument is a Horiba CAPA-500 centrifugal particle analyzer, manufactured by Horiba Instruments, Inc., Irvine, Calif. In determining particle size by area, a solvent viscosity of 1.24 cps, solvent density of 0.76 g/cc, sample density of 1.32 using a centrifugal rotation of 1,000 rpm, a particle size by area range of 0.01 to less than 10 μm, and a particle size by area cut of 1.0 μm are used.

Since these two instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Malvern instrument.

After cooling and separating the dispersion of reduced size toner particles from any particulate media that may have been used by means known to those skilled in the art, it is possible to reduce the concentration of the toner particles in the dispersion, impart an electrostatic charge of predetermined polarity to the toner particles, or a combination of these variations. The concentration of the toner particles in the dispersion may be further reduced by the addition of additional liquid, preferably nonpolar liquid, as described below. The dilution is normally conducted to reduce the concentration of toner particles to between 0.1 to 10 percent by weight, preferably 0.3 to 3.0, and more preferably 0.5 to 2 weight percent with respect to the liquid. One or more liquid soluble ionic or zwitterionic charge director compounds (C), of the type set out below, can be added to impart a positive or negative charge, as desired. The addition may occur at any time during the process; preferably at the end of the process, e.g., after the particulate media are removed and the required concentration of toner particles is accomplished. If a diluting liquid is also added, the ionic or zwitterionic compound can be added prior to, concurrently with, or subsequent thereto. If an adjuvant compound of a type described below has not been previously added in the preparation of the developer, it can be added prior to or subsequent to the developer being charged. Preferably the adjuvant compound is added after the dispersing step.

The toner particles are prepared from at least one thermoplastic polymer or resin, suitable additives such as colorants, and other additives as described in more detail below. The toner particles are dispersed in liquids, preferably nonpolar liquids. Additional components can be added to the dispersion, e.g., charge director, adjuvants, polyethylene, fine particle size inorganic oxides such as silica, etc.

The nonpolar liquids that are useful preferably include: branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications are met when components, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Pont (°C.) | Auto-Ignition Temp (°C.) |
|---|---|---|
| Norpar ® 12 | 69 | 204 |
| Norpar ® 13 | 93 | 210 |

-continued

| Liquid | Flash Pont (°C.) | Auto-Ignition Temp (°C.) |
|---|---|---|
| Norpar ® 15 | 118 | 210 |

All of the nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred nonpolar liquids, the essential characteristics of all suitable nonpolar liquids are the electrical volume resistivity and the dielectric constant. In addition, a feature of the nonpolar liquids is a low Kauri-butanol value less than 30, preferably in the vicinity of 27 or 28, determined by ASTM D 1133. It is possible to replace up to 100% of the nonpolar liquid with a polar liquid having a Kauri-butanol value of at least 30. The ratio of resin to liquid is such that the combination of ingredients becomes fluid at the working temperature. In use, the liquid is present in an amount of 80 to 99.9% by weight, preferably 97 to 99.5% by weight, based on the total weight of liquid developer. The total weight of solids in the liquid developer is 0.1 to 20%, preferably 0.5 to 3.0% by weight. The total weight of solids in the liquid developer is solely based on the resin, including components dispersed therein, e.g., pigment component, adjuvant, etc.

Useful thermoplastic resins or polymers include: ethylene vinyl acetate (EVA) copolymers (Elvax ® resins, E. I. du Pont de Nemours and Company, Wilmington, Del.), copolymers of ethylene and an $\alpha\beta$-ethylenically unsaturated acid selected from the group consisting of acrylic acid and methacrylic acid, copolymers of ethylene (80 to 99.9%)/acrylic or methacrylic acid (20 to 0%)/alkyl (C1 to C5) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, Del.; acrylic resins, such as a copolymer of acrylic or methacrylic acid (optional but preferred) and at least one alkyl ester of acrylic or methacrylic acid wherein alkyl is 1 to 20 carbon atoms, e.g., methyl methacrylate (50 to 90%)/methacrylic acid (0 to 20%)/ethyl hexyl acrylate (10 to 50%); etc., or blends thereof.

Preferred copolymers are the copolymer of ethylene and an $\alpha$, $\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt indices (g/10 minute) of 10 to 500 for these copolymers is determined by ASTM D 1238 Procedure A.

30 Particularly preferred copolymers of this type have an acid number of 66 and 54 and a melt index of 100 and 500 determined at 190° C., respectively.

In addition, the resins have the following preferred characteristics:

1. Able to disperse the additive, e.g., colorant such as pigment, adjuvant, e.g., metallic soap, etc.

2. Substantially insoluble in the liquid at temperatures below 40° C., so that the resin will not dissolve or solvate in storage, 3. Able to solvate at temperatures above 50° C., 4. Able to be ground to form particles between 0.1 $\mu$m and 5 $\mu$m, in diameter preferred size), e.g., determined by Horiba CAPA-500 centrifugal automatic particle analyzer, manufactured by Horiba Instruments, Inc., Irvine, Calif.; and between 1 $\mu$m and 15 $\mu$m, in diameter, e.g., determined by Malvern 3600E Particle Sizer, manufactured by Malvern, Southborough, Mass., 5. Able to form a particle (average by area) of less than 10 $\mu$m, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 $\mu$m to less than 10 $\mu$m, and a particle size cut of 1.0 $\mu$m; and 30 $\mu$m average particle size determined by Malvern 3600E Particle Sizer, 6. Able to fuse at temperatures in excess of 70° C.

"Solvation" in 3. above means that the resins forming the toner particles will become swollen or gelatinous.

Suitable liquid soluble ionic or zwitterionic charge director compounds (C) are present in the liquid with the dispersed toner particles to form a liquid electrostatic developer. Charge director compounds are generally used in an amount of 0.25 to 1500 mg/g, preferably 2.5 to 400 mg/g developer solids, include: negative charge directors, e.g., lecithin, Basic Calcium Petronate ®, Basic Barium Petronate ® oil-soluble petroleum sulfonate, manufactured by Sonneborn Division of Witco Chemical Corp., New York, N.Y., alkyl succinimide (manufactured by Chevron Chemical Company of Calif.), etc.; positive charge directors, e.g., anionic glycerides such as Emphos ® D70-30C, Emphos ® F27-85, etc., manufactured by Witco Chem. Corp., New York, N.Y., sodium dioctylsulfosuccinate (manufactured by American Cyanamid Co.), ionic charge directors such as zirconium octoate, copper oleate, iron naphthenate etc.; nonionic charge directors such as polyethylene glycol sorbitan stearate, as well as nigrosine and triphenylmethane type dyes.

As indicated above, colorants are additives that are dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow TY-858-D | Heubach | Yellow 74 |
| Hansa Yellow X | Hoechst | Yellow 75 |
| Novoperm ® Yellow HR | Hoechst | Yellow 83 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |
| L75-2377 Yellow | Sun Chem. | |
| Hostaperm ® Orange GR | Hoechst | Orange 43 |
| Paliogen ® Orange | BASF | Orange 51 |
| Irgalite ® 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | |
| Mogul L | Cabot | |
| BK 8200 Black Toner | Paul Uhlich | |

Other ingredients may be added to the electrostatic liquid developer, such as fine particle size inorganic oxides, e.g., silica, alumina, titania, etc.; preferably in the order of 0.5 μm or less can be dispersed into the liquefied resin. These oxides can be used instead of the colorant or in combination with the colorant. Metal particles can also be added.

Another additional component of the electrostatic liquid developer is an adjuvant which can be selected from the group consisting of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydryoxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxy ethyl)ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout U.S. Pat. Nos. 4,707,429 and 4,740,444 and is an additive. The metallic soap can be present in an amount of 0.01 to 60% in weight based on the total weight of solids.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C10 alkyl-substituted benzenes manufactured by Exxon Corp., etc. as described in Mitchell U.S. Pat. No. 4,631,244.

The disclosures of the above-listed United States patents describing the adjuvants are incorporated herein by reference.

The particles in the electrostatic liquid developer have an average particle size of less than 30 μm, preferably the average particle size is less than 10 μm determined by the Malvern 3600E Particle Size Analyzer described above. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

INDUSTRIAL APPLICABILITY

The improved process of this invention produces a dispersion of resin particles in a liquid, preferably as a liquid electrostatic developer. The liquid developer contains toner particles having a controlled particle size range which can be prepared in large volume more quickly and economically than by previously known processes for making liquid electrostatic developers. The liquid developer is particularly useful in copying, e.g., making office copies of black and white as well as various colors; or color proofing, e.g., a reproduction of an image using the standard colors: yellow, cyan and magenta together with black as desired. In copying and proofing the toner particles are applied to a latent electrostatic image. Other uses are envisioned for the toner particles, e.g., the formation of copies or images using toner particles containing finely divided ferromagnetic materials or metal powders; conductive lines using toners containing conductive materials, resistors, capacitors and other electronic components; lithographic printing plates, etc.

EXAMPLES

The following examples wherein the parts and percentages are by weight illustrate but do not limit the invention. In the examples the melt indices were determined by ASTM D 1238, Procedure A, the average particle sizes were determined by a Malvern 3600E Particle Sizer, manufactured by Malvern, Southborough, Mass., as described above, the conductivity was measured in picomhos/cm (pmhos) at 5 hertz and low voltage, 5 volts, and the density was measured using a Macbeth densitometer model RD918. The resolution is expressed in the examples in line pairs/mm (lp/mm). No. average molecular weight is determined by known osmometry techniques and weight average molecular weight is determined by gel permeation chromatography (GPC). pph means pounds per hour.

EXAMPLE 1

A solid pre-blend of 80 pph ethylene (89%)/methacrylic acid (11%), melt index at 195° C. of 100, and acid no. of 66; 18.1 pph Stirling ®NS N 774 Carbon Black pigment, Pigment Black 7, C.I. 77266; 0.9 pph Monastral ® Blue BT 583D, Pigment Blue 15, C.I. No. 74160; and 1.0 pph aluminum stearate (Witco 132), manufactured by Witco Chemical Corporation, NY, N.Y., was prepared in a ribbon blender, which processes roughly 50 lbs per batch. The blender was operated for one hour at room temperature and discharged into a polyethylene-lined container. The resultant blend was placed in the feed hopper 2 of a commercial twin screw extruder, a melt/dispersion apparatus; specifically, a 28 mm Werner & Pfleiderer counter-rotating device, manufactured by Werner & Pfleiderer Company, Stuttgart, W. Germany. The feed hopper 2 was equipped with a screw auger which was manipulated to regulate the feed rate of solid material into the feed throat of the extruder. The screw was designed to provide intense mixing, with five kneading block sections along the length, providing a total kneading length of 285 mm on the 774 mm long screws. The screw auger was regulated at 15 rpm providing a solid feed rate into the extruder of about 6.8 lb/hour (0.00085 kg/second). The screws were rotated at 300 rpm to provide the required degree of dispersion of the pigment and additives into the resin. At a point 654 mm from the feed end of the screw, in Zone 3, liquid Isopar ®-L hydrocarbon was pumped into the extruder with a positive displacement pump 3, a Lapp diaphragm pump manufactured by Lapp Process Equipment, LeRoy, N.Y., through a liquid injector with a 0.125 inch (~3.18 mm) orifice at its discharge. The Isopar ®-L was supplied to the Lapp pump from a tank at atmospheric pressure and room temperature. The Lapp pump speed was adjusted to provide about 12.6 lb/hour (0.00158 kg/second) of Isopar ®-L into the extruder. During start-up of the process, extrusion of the solid components is established before introduction of the Isopar ®-L. Consequently, the Isopar ®-L supply pump must be capable of providing and the supply system capable of sustaining pressure of up to 600 psig to initially establish flow into the extruder. After the flow line is fully cleared, only about 50 psig is required to maintain proper flow rate. The extruder was equipped with three heating jackets along the barrel length, each with an imbedded thermocouple and valved cooling water for fine regulation of temperature. In addition, the feed throat was equipped with a cooling water jacket to ensure proper feeding of the solid material below room temperature. The first heated zone (Zone 2) was controlled to about 110° C., and the two downstream zones to 115° C. At the end of the extruder was a transition zone, about 10 inches (25.4 cm) long, with two band heaters and imbedded thermocouples. In the first stage of this transition zone, was placed a pressure transducer. These temperatures were both controlled to 110° C. and the pressure at the discharge of the extruder was typically less than 50 psig. The transition zone was connected to a static mixer 4, 12 inches (30.48 cm) long, 1 inch (2.54 cm) in diameter, wrapped with a cord heating element (160 watts) attached to a temperature controller regulating to 150° C. The mean residence time of the mixture in the static mixer was 30 seconds. The static mixer discharged into an extension pipe and 1 inch (2.54 cm) tubing cross. At one exit of the cross was an extrusion die 5 with a 1/16 inch (0.159 cm) orifice. The die was heated with a band heater, also regulated to 150° C. At another exit of the tube cross was placed a pressure transducer, used to determine the flow rate of extrudate through the orifice. And at the other exit was a needle valve leading to a waste container. The position of the needle valve was adjusted to regulate the flow rate of fluid through the extrusion die. A thermocouple placed in the tube cross indicated melt temperature of about 130° C. The dispersion discharged from the die contained about 35% solids and the flow was regulated with the needle valve to about 6.9 lb/hour (0.00087 kg/second). The remaining dispersion, about 12.5 lb/hour (0.00156 kg/second), was discharged through the needle valve into a storage container, where it was allowed to freeze. The dispersion from the die was discharged into a funnel which supplied feed to a high shear cooling element 6, a Premier Supermill manufactured by Premier Mill Corp., Reading, Pa.

A 1 inch (2.54 cm) stainless steel tubing line, wrapped with cord heaters, connected the funnel to a positive displacement pump 7, a Moyno progressive cavity pump manufactured by Robbins & Myers, Inc., Springfield, Ohio, which was also wrapped with cord heaters. The transfer line between the pump and the mill entrance was also wrapped 1 inch (2.54 cm) stainless steel tubing. Each of these cord heaters was manipulated to regulate the tubing temperature to 150° C. to ensure that the feed remained fluid. The mill was filled with 1180 cc of case-hardened steel shot, 1 mm in diameter, providing a free volume of about 665 cc. The mill discs were rotated at a tip speed of 2500 ft/minute (1270 cm/second) and the mill was water jacketed. The flow rate of water to the jacket was manipulated to regulate the discharge temperature of the dispersion to 30°-40° C. Additional Isopar ®-L was added, through line 8 to the mill to freeze the resin under the shear provided by the media. The Isopar ®-L was supplied from a nitrogen pressurized tank through an integral orifice flow meter and a flow control valve 9. For this example, the flow of Isopar ®-L was regulated at about 8.2 lb/hour (0.00103 kg/second), which resulted in a mean residence time in the mill of about 4.1 minutes and a discharge solids loading of 16%. The mill discharge was a stable, pumpable paste or dispersion which could be stored for further processing. For particle size reduction, the stable paste or dispersion was diluted with addition Isopar ®-L added through line 12 which contains a flow control valve 13 to provide a 10% solids level and then was passed through a size reduction mill 10, a continuous ball mill at a controlled flow rate through line 11 that was equivalent to a mean residence time of 10 minutes/pass. During this cold grinding stage, the temperature was always maintained below 30° C. Sample 1 was passed through the mill six times resulting in a total grinding residence time, including the 4 minutes required for phase inversion, of 64 minutes. Sample 2 experienced 12 passes through the mill for a total grinding residence time of about 124 minutes. Product was collected in 1 gallon plastic jugs.

Toner Samples 1 and 2 were diluted to 2% solids, charged with Basic Barium Petronate ® oil-soluble petroleum sulfonate, Sonneborn Division, Witco Chemical Corp., NY, N.Y. (63 mg/g), and evaluated on a Savin 870 copier under standard conditions: charging corona set at 6.8 kV and transfer corona set at 8.0 kV using carrier sheets identified in Table 1 below. The average particle size of these toners, determined on a Malvern 3600E Particle Sizer, is 7.9 μm for Sample 1 and 6.0 μm for Sample 2. The results are set out in Table 1 below:

TABLE 1

| TONER SAMPLE | COND. (pmho) | PAPER | DENSITY | RESOLUTION (lp/mm) | TRANSFER EFFICIENCY (%) |
|---|---|---|---|---|---|
| 1 | 37 | FORTUNE[1] | 1.7 | 9 | 80 |
| | | SAVIN 2200 | 1.2 | 9 | 82 |
| 2 | 40 | FORTUNE[1] | 1.7 | 9 | 89 |
| | | SAVIN 2200 | 1.1 | 9 | 87 |

[1]FORTUNE Gloss paper manufactured by Consolidated Papers, Inc.

EXAMPLE 2

A solid pre-blend of 73 pph of ethylene (89%)/methacrylic acid (11%) described in Example 1; 12.5 pph of magenta pigment R6713 (Mobay Chemical Corporation, Haledon, N.J.), 12.5 pph magenta pigment R6700 (Mobay), and 2.0 pph aluminum stearate (Witco 132) was prepared in a ribbon blender and processed as described in Example 1 with the following exceptions: extruder heated zone temperatures were 140° C., 130° C., and 115° C., the transfer line temperatures were both 120° C. and the melt temperature at the die was between 120° C. and 130° C., solids concentration at the extrusion die averaged 38%, the solid concentration at the mill discharge after phase inversion averaged 16%, the mill discharge was regulated between 20° C. and 30° C., the toner was passed through the cold grinding stage 12 times for a total residence time in grinding of 124 minutes resulting in a toner having an average particle size of 7.7 μm as measured by a Malvern 3600E Particle Sizer the toner was diluted to 2% solids, and charged with 70 mg/g Basic Barium Petronate ® described in Example 1. The developer was evaluated by toning a photopolymer xeroprinting master. A photopolymerizable composition consisting of 57.0% (by weight) poly(-styrenemethylmethacrylate), 28.6% ethoxylated trimethylolpropane triacrylate, 10.6% 2.2'4,4'-tetrakis (o-chlorophenyl)-5,5'-bis(m,p-dimethoxyphenyl)-biimidazole, and 3.8% 2-mercaptobenzoxazole was coated on an 0.004 inch (0.0102 cm) aluminized polyethylene terephthalate film substrate. A 0.00075 inch (0.0019 cm) polypropylene cover sheet was laminated to the dried photopolymerizable layer. The photopolymerizable element was exposed imagewise through a halftone negative film with its emulsion side in contact with the cover sheet, using a Douthitt Option X exposure unit (Douthitt Corp., Detroit, Mich.), equipped with a model TU 64 Violux ®5002 lamp assembly (Exposure Systems Corp., Bridgeport, Conn.) and a photopolymer type 5027 lamp. The cover sheet was then removed. For evaluation of the charged developers, the film was charged positively by passing over a 4.9 kV corotron at 2 inches (5.08 cm)/second. The toned image was then transferred to paper with a positive transfer corona of 4.3 kV at 2 inches (5.08 cm)/second. The image was then fused in an oven at 100° C. The results are set out in Table 2 below:

TABLE 2

| COND. (pmho) | PAPER | DENSITY | RESOLUTION[3] | TRANSFER EFFICIENCY |
|---|---|---|---|---|
| 27 | Solitaire[1] | 1.31 | 2-97 | Excellent |
| | AD Proof[2] | 1.39 | 2-97 | Good |

[1]Plainwell Paper Co., Plainwell, MI
[2]Appleton Paper Co., Appleton, WI
[3]Dot range of half tone dots with 150 line screen.

EXAMPLE 3

A solid pre-blend of 78 pph of ethylene (89%)/methacrylic acid (11%) described in Example 1, 20 pph yellow pigment flush, AAOT Yellow 14, Pigment Flush Sun #L74-1357, and 2.0 pph aluminum stearate (Witco 132) was prepared in a ribbon blender and processed as described in Example 1 with the following exceptions: all of the material that exited the extruder was passed through the extrusion die into the Premier Supermill (17.9 lb/hour (0.00224 kg/second)) at 38% solids loading and Isopar ®-L was added to the mill at 16.1 lb/hour (0.00201 kg/second), resulting in a mean residence time in the mill of about 2 minutes and a discharge concentration of 20% solids at 35° C. to 45° C. When the discharge temperature exceeded 50° C., the dispersion was unstable and the resin was the continuous, rather than the dispersant, phase. The resultant dispersion which had an average particle size of 38.9 μm as measured by a Malvern 3600E Particle Sizer, was passed through a MicroFluidizer ®M-110 at 4.6% solids with an internal pressure of 17,000 psig to give a material with a particle size of 7.2 μm as measured by the Malvern 3600E Particle Sizer. This material was diluted to 1.5% solids and charged with 54 mg/g Basic Barium Petronate ® described in Example 1. The developer was evaluated by toning a photopolymer xeroprinting master as described in Example 2 using the process described in that example. The results are set out in Table 3 below:

TABLE 3

| COND. (pmho) | PAPER | DENSITY | RESOLUTION[1] | TRANSFER EFFICIENCY |
|---|---|---|---|---|
| 10 | Solitaire | 1.32 | 3-97 | Good |

[1]Dot range of half tone dots with 150 line screen.

EXAMPLE 4

A solid pre-blend of 73 pph polystyrene, weight ave. molecular wt. 250,000, Aldrich, Milwaukee, Wis., 12.5 pph magenta pigment R6713 (Mobay), 12.5 pph magenta pigment R6700 (Mobay), and 2.0 pph Aluminum stearate (Witco 132) was prepared in a ribbon blender and processed according to Example 1 with the following exceptions: a polar liquid, Aromatic® 150, Exxon Corp., was used in place of Isopar®-L in the feed to the extruder, to the mill, and for dilution to 10% for cold grinding. Toner taken after three passes through the cold grinding mill for a total grinding residence time of 34 minutes had a particle size, as measured with a Malvern 3600E Particle Sizer, of 4.3 μm.

EXAMPLE 5

A solid pre-blend of 73 pph ethylene (91%)/methacrylic acid (9%), melt index at 195° C. of 500, and acid no. of 54, 12.5 pph magenta pigment R6713 (Mobay), 12.5 pph magenta pigment R6700 (Mobay), and 2.0 pph aluminum stearate (Witco 132) was prepared in a ribbon blender and processed as described in Example 1 with the following exceptions: extruder zone temperatures were 70° C., 110° C., and 105° C., the transition zone temperatures were 95° C. and 110° C., the melt temperature at the extrusion die was 115° C., and all of the extrudate was sent through the mill for the phase inversion step, resulting in a residence time of about 2 minutes and a discharge temperature of 20° C. to 25° C. Without any cold grinding, Malvern 3600E Particle Sizer average particle sizes of 4 to 9 μm resulted, compared to about 30 μm when ethylene (89%)/methacrylic acid (11%) as described in Example 1 was used. The toner was cold ground in the Premier Supermill (Example 1) resulting in an average particle size, as measured with a Malvern 3600E Particle Sizer, of 4.3 μm after a residence time of 124 minutes in the Premier Supermill.

We claim:

1. A continuous process for the preparation of a dispersion of liquid and thermoplastic resin or polymer particles having at least one additive dispersed in the thermoplastic resin or polymer particles for use in the preparation of electrostatic liquid developers comprising, in order, A. introducing an intimate blend of resin and at least one additive continuously into an apparatus having means for melting the resin and dispersing the additive in the resin, B. melting the resin in said apparatus at an elevated temperature but below that at which the resin and/or additive decomposes, C. moving continuously the blend of melted resin and additive through at least one mixing element of said apparatus whereby the additive is thoroughly dispersed in the melted resin to form a molten blend of resin and additive, D. forming a dispersion by introducing into said molten blend while it is still in the at least one mixing element of said apparatus a liquid in which the resin and at least one additive are substantially insoluble and mixing said molten blend thoroughly in the liquid, the temperature in the at least one mixing element being maintained above the temperature at which said molten blend remains in its molten state, and E. introducing continuously the dispersion into a high shear cooling apparatus wherein the molten blend solidifies forming a stable dispersion of resin particles in the liquid, the resin particles having an average by area particle size of less than 30 μm.

2. A process according to claim 1 wherein the intimate blend of resin and at least one additive is prepared in a dry blender.

3. A process according to claim 1 wherein the melt/dispersing apparatus is a twin screw extruder equipped with heating means

4. A process according to claim 3 wherein the apparatus has at least four zones, resin feeding zone (1), resin melting zone (2), kneading, blending or mixing zone (3) and melt pumping zone (4).

5. A process according to claim 4 wherein the intimate blend of resin and at least one additive is introduced into the apparatus in the feeding zone and the liquid is introduced into the apparatus in the kneading, blending or mixing zone.

6. A process according to claim 4 wherein the apparatus has as a final zone, a transition zone (5) equipped with heating means.

7. A process according to claim 6 wherein the temperature ranges maintained in the zones of the apparatus are: (1) ambient temperature, (2) 80° C. to 120° C., (3) and (4) 110° C. to 140° C., and (5) 100° C. to 120° C.

8. A process according to claim 1 wherein the dispersion after step D passes continuously from the melt/dispersing apparatus through a mixer equipped with heating means.

9. A process according to claim 8 wherein the dispersion passes continuously from the mixer into a high shear cooling apparatus wherein the dispersion is cooled to permit precipitation of the resin particles out of the liquid to form a stable dispersion.

10. A process according to claim 1 wherein the high shear cooling apparatus is a continuous ball mill containing particulate media.

11. A process according to claim 9 wherein the high shear cooling apparatus is a continuous ball mill containing particulate media.

12. A process according to claim 10 wherein in step E additional liquid is added to the high shear cooling apparatus to reduce the concentration of toner particles in the liquid.

13. A process according to claim 12 wherein the concentration of toner particles in the liquid is reduced to between 0.1 to 3 percent by weight with respect to the liquid.

14. A process according to claim 10 wherein the high shear cooling apparatus contains particulate media.

15. A process according to claim 14 wherein the particulate media are selected from the group consisting of stainless steel, ceramic, alumina, zirconia, silica, and stillimanite.

16. A process according to claim 15 wherein the particulate media are spherical having an average diameter of 0.04 to 0.5 inch.

17. A process according to claim 1 wherein after step E the stable dispersion passes continuously through a size reduction mill.

18. A process according to claim 17 wherein the size reduction mill is a continuous ball mill containing particulate media.

19. A process according to claim 17 wherein the size reduction mill is an attritor.

20. A process according to claim 17 wherein the size reduction mill has a plurality of nozzles within a liquid jet interaction chamber at a liquid pressure of at least 1,000 psig.

21. A process according to claim 17 wherein the stable dispersion passes through the size reduction mill at least two times.

22. A process according to claim 1 wherein after step E the stable dispersion passes consecutively at least one time through a series of size reduction mills.

23. A process according to claim 9 wherein the stable dispersion passes continuously from the high shear cooling apparatus into a size reduction mill.

24. A process according to claim 23 wherein the size reduction mill is a continuous ball mill containing particulate media.

25. A process according to claim 23 wherein the size reduction mill is an attritor.

26. A process according to claim 23 wherein the size reduction mill has a plurality of nozzles within a liquid jet interaction chamber at a liquid pressure of at least 1,000 psig.

27. A process according to claim 23 wherein the stable dispersion passes through the size reduction mill at least two times.

28. A process according to claim 9 wherein after step E the stable dispersion passes consecutively at least one time through a series of size reduction mills.

29. A process according to claim 1 wherein the liquid is a nonpolar liquid having a Kauri-butanol value of less than 30.

30. A process according to claim 1 wherein the liquid is a polar liquid having a Kauri-butanol value of 30 and greater.

31. A process according to claim 1 wherein the liquid is a mixture of a nonpolar liquid having a Kauri-butanol value of less than 30 and a polar liquid having a Kauri-butanol value of 30 and greater.

32. A process according to claim 1 wherein the thermoplastic resin is a copolymer of acrylic or methacrylic acid and at least one alkyl ester of acrylic or methacrylic acid wherein alkyl is 1 to 20 carbon atoms.

33. A process according to claim 32 wherein the thermoplastic resin is a copolymer of methylmethacrylate (50 to 90%)/methacrylic acid (0 to 20%)/ethylhexyl acrylate (10 to 50%) wherein the percentages are by weight.

34. A process according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

35. A process according to claim 34 wherein the thermoplastic resin is a copolymer of ethylene (89%)/methacrylic acid (11%) having a melt index at 190° C. of 100.

36. A process according to claim 1 wherein the thermoplastic resin is polystyrene.

37. A process according to claim 1 wherein a colorant additive is blended with the resin in an amount up to 60% by weight based on the total weight of developer solids.

38. A process according to claim 37 wherein the colorant is a pigment.

39. A process according to claim 37 wherein the colorant is a dye.

40. A process according to claim 1 wherein a fine particle size inorganic oxide is blended with the resin.

41. A process according to claim 1 wherein the thermoplastic resin particles have dispersed therein a metallic soap.

42. A process according to claim 41 wherein the metallic soap is aluminum tristearate.

43. A process according to claim 41 wherein the metallic soap is present in 0.01 to 60% by weight based on the total weight of solids.

44. A process according to claim 1 wherein after step E a charge director in an amount of 0.25 to 1500 mg/g solids is added to impart an electrostatic charge of predetermined polarity to the resin particles.

45. A process according to claim 44 wherein the charge director is lecithin.

46. A process according to claim 44 wherein the charge director is oil soluble petroleum sulfonate.

47. A process according to claim 44 wherein the thermoplastic resin is a copolymer of ethylene (89%) and methacrylic acid (11%) having a melt index at 190° C. of 100.

48. A process according to claim 44 wherein an additional compound is present which is an adjuvant selected from the group consisting of polyhydroxy compound, aminoalcohol, polybutylene succinimide and an aromatic hydrocarbon.

49. A process according to claim 48 wherein the adjuvant is a polyhydroxy compound.

50. A process according to claim 48 wherein the adjuvant is an aminoalcohol.

51. A process according to claim 48 wherein the adjuvant is polybutylene succinimide.

52. A process according to claim 48 wherein the adjuvant is an aromatic hydrocarbon.

53. A process according to claim 1 wherein the resin particles have a plurality of fibers integrally extending therefrom.

54. A process according to claim 44 wherein the resin particles have a plurality of fibers integrally extending therefrom.

55. A process according to claim 1 wherein the blending of the resin and at least one additive occurs in a mixing element of the apparatus.

* * * * *